United States Patent [19]

Vecellio

[11] Patent Number: 4,539,932

[45] Date of Patent: Sep. 10, 1985

[54] ROBOT PAINTING SYSTEM FOR AUTOMOBILES

[75] Inventor: Anthony M. Vecellio, Royal Oak, Mich.

[73] Assignee: General Motors Corporation, Detroit, Mich.

[21] Appl. No.: 597,017

[22] Filed: Apr. 5, 1984

Related U.S. Application Data

[62] Division of Ser. No. 481,119, Apr. 1, 1983.

[51] Int. Cl.[3] ..... B05B 3/00; B05B 5/00

[52] U.S. Cl. ..... 118/697; 118/622; 118/629; 118/631; 118/634

[58] Field of Search ..... 427/31; 98/115 SB; 901/43, 7; 239/700; 118/696, 697, 622, 629, 631, 634

[56] References Cited

U.S. PATENT DOCUMENTS

| | | | |
|---|---|---|---|
| 2,930,350 | 3/1960 | Gengenbach et al. | 118/631 |
| 3,279,421 | 10/1966 | Tilney et al. | 118/631 |
| 4,086,522 | 4/1978 | Engleberger et al. | 901/7 |
| 4,133,255 | 1/1979 | Guice | 98/115 SB |
| 4,171,100 | 10/1979 | Benedek et al. | 239/700 |
| 4,348,731 | 9/1982 | Kogawa | 901/43 |

FOREIGN PATENT DOCUMENTS

| | | | |
|---|---|---|---|
| 82/00963 | 4/1982 | European Pat. Off. | 427/407 |

OTHER PUBLICATIONS

Automotive Engineer, Oct./Nov. 1983, p. 24.
Sheet Metal Industries, Oct. 1981, pp. 761–825.
Mullins, Worlds Greatest Production Line—The European View, Automotive Industries, Dec. 1981, pp. 48–50.
Tholome et al., Industrial Finishing, pp. 30–35, Nov. 1977.
The Industrial Robot, Dec. 1981, pp. 230–232.

*Primary Examiner*—Richard Bueker
*Attorney, Agent, or Firm*—Edward J. Biskup

[57] ABSTRACT

A robot painting system for electrostatically painting an automobile body that includes a paint module adapted to maintain the automobile body in a stationary position relative to at least two painting robots, each of which carries a rotary bell-type atomizing device and provides programmed movement thereof about five control axes at a speed which prevents the cone-shaped pattern of atomized paint particles from being distorted due to any gyroscopic effect developed by the atomizing device as it is moved about the control axes.

3 Claims, 2 Drawing Figures

ROBOT PAINTING SYSTEM FOR AUTOMOBILES

Figure 1:
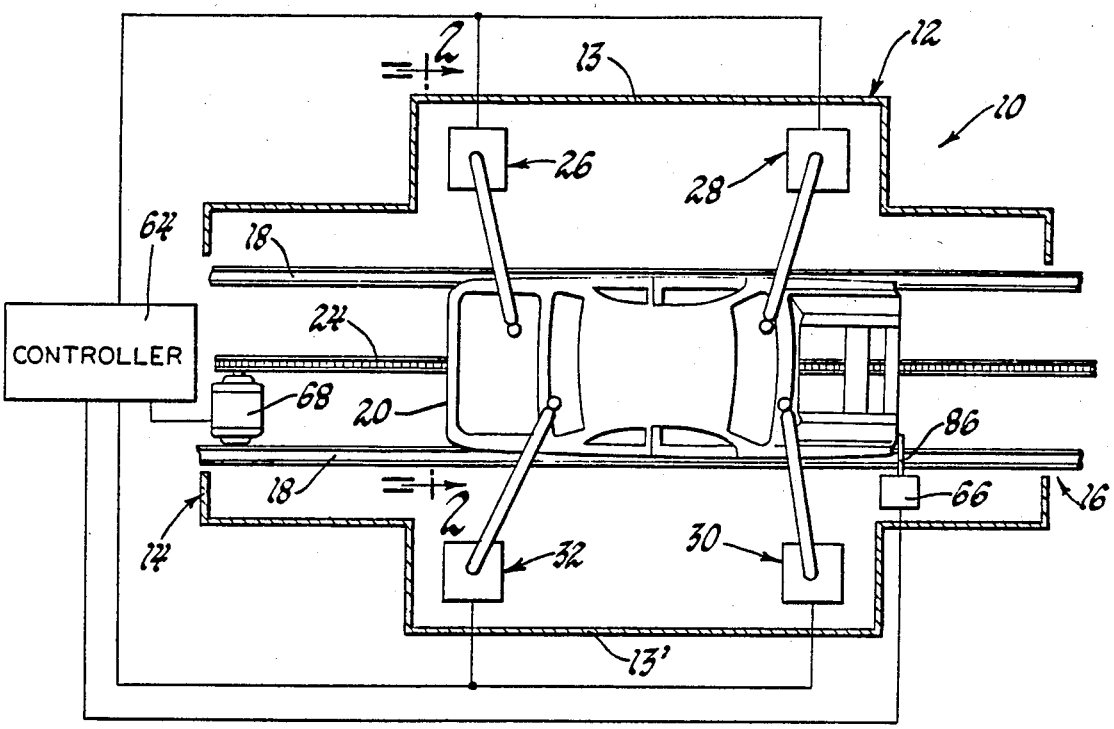

This is a division of application Ser. No. 481,119 filed on April 1, 1983.

This invention concerns a painting system and more particularly a robot painting system and method for electrostatically painting automobile bodies in a stationary position with a miniaturized, high speed, rotary atomizing device mounted on the free end of a multi-axis programmable robot.

Over the years the painting of automobiles in production plants has evolved from the inefficient, conventional air-type spray guns operated manually or by a mechanical reciprocator to electrostatic air-spray guns and electrostatic rotary atomizing devices which have increased paint transfer efficiency appreciably. One problem, however, with the electrostatic paint apparatus and methods presently used for painting automobile bodies is that, during the painting process, the bodies are carried by a high-speed conveyor which moves the bodies through a long paint booth that houses a plurality of prepositioned, large, cumbersome, rotary atomizing devices or a plurality of robots fitted with air-spray guns. It has been found that when the automobile body passes through a paint booth using the robotized air-spray guns, the paint transfer efficiency is about 30 percent and approximately 35 percent of the vehicle body is painted. This can be attributed to a number of factors, not the least of which is the use of high pressure air for atomizing the paint and the combined relative movement of the body and the air guns. Even if the vehicle body is maintained stationary so that 100 percent of the body can be painted, the transfer efficiency of a robotized air-spray gun system has been found to be no more than about 40 percent. As a result, additional paint stations located along the production line must be provided to touch-up and paint the remaining 65 percent of the body. As to paint systems where the automobile body is painted by prepositioned rotary atomizing devices, although improved transfer efficiency of approximately 80 percent can be reached as the body moves through the spray booth and paint coverage of about 65 percent of the body is realized, this type of paint system is not considered entirely satisfactory because additional paint stations are still required to provide complete coverage of the body.

As a result, a need has existed for a new and improved paint system and method which would not only provide high efficiency in paint transfer but also eliminate the need for additional paint stations presently required for providing full coverage of the automobile body. To this end I have discovered that electrostatic paint transfer efficiency on an order of 80 percent as well as 100 percent body coverage, can be obtained with a robot system consisting of two or more program-controlled robots, each of which has at least five degrees of freedom, carries a light weight, miniaturized rotary bell-type atomizing device and moves the atomizing device at a small fraction of standard painting speeds. In the preferred form of my invention, the entire painting process is performed with the automobile body maintained stationary and the bell of the atomizing device is rotated at a speed which causes mechanical atomization of a liquid paint supplied to the bell. In addition, during atomization of the liquid paint, an electrostatic field is created between the atomizing device and the automobile body that causes the atomized paint particles to be directed from the atomizing device to the automobile body in a cone-shaped pattern, and the speed of movement of the atomizing device about the five axes is controlled so as to prevent the cone pattern of the paint particles from being disturbed or distorted by any gyroscopic effect which may be created by the high-speed rotating bell as it is moved to different positions along a path that follows the surface contours of the body.

Accordingly, the objects of the present invention are to provide a new and improved robot 'system and method for electrostatically painting an automobile body and that utilizes a miniaturized, high-speed rotating bell-type atomizing device which causes mechanical atomization of a liquid paint and is movable along the interior and exterior irregular surface contours of the automobile body at a predetermined distance therefrom and at a relatively slow speed preferably not greater than 1.4 feet/second; to provide a new and improved robot system and method for electrostatically painting an automobile body in which at least two robots are positioned adjacent the body and each robot is provided with an arm having a head that is program-controlled and carries a high-speed, bell-type atomizing device of a predetermined small size and movable about five control axes for painting the interior and exterior of the body while the latter is in a stationary position; to provide a new and improved robot paint system and method for electrostatically painting an automobile body in which the robot has an arm provided with a head movable about five control axes and carries a rotary, bell-type atomizing device of a size that allows it to be moved about the five control axes while positioned within the interior of an automobile body; to provide a new and improved robot system and method for electrostatically painting a stationary automobile body located in a paint module and that utilizes a high-speed rotary bell-type atomizing device for atomizing a liquid paint and is movable about five control axes at a speed incapable of distorting the cone pattern of atomized paint particles created by the electrostatic field; and to provide a new and improved robot system and method for electrostatically painting a stationary automobile body that includes a program-controlled robot having an arm provided with a wrist which supports a rotary bell-type atomizing device that rotates at a speed sufficient to mechanically atomize liquid paint supplied thereto and in which the atomizing device is movable relative to the surface of the automobile body at a speed which prevents the cone pattern of the paint particles from being distorted due to any gyroscopic effect developed by the atomizing device when moved about at least five control axes.

Figure 2:
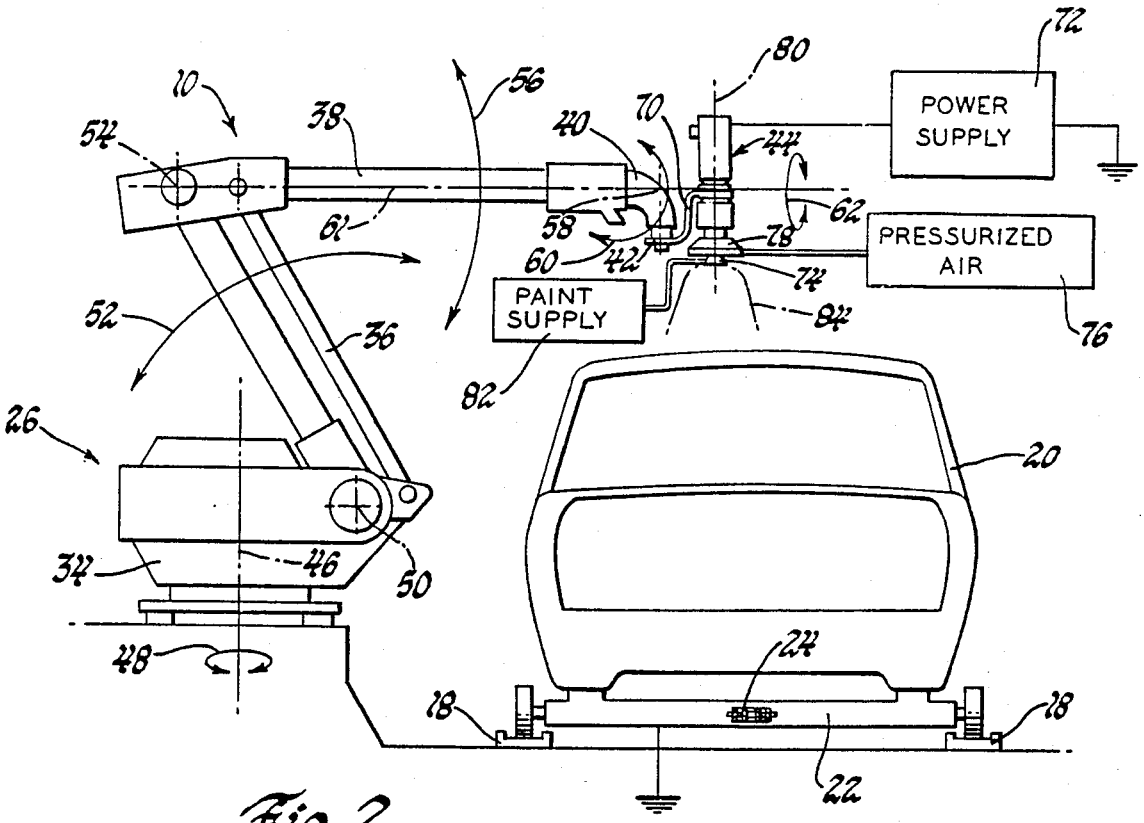

Other objects and advantages of the present invention will be apparent from the following detailed description when taken with the drawings in which:

FIG. 1 is a plan view of an automobile located in a paint module and being painted by a robot painting system and method according to the present invention, and FIG. 2 is an enlarged view taken on line 2—2 of FIG. 1 and shows an elevational side view of one of the robots utilized in the robot painting system and method according to the present invention for electrostatically painting a stationary automobile.

Referring to the drawings and more particularly FIGS. 1 and 2 thereof, a robot painting system 10 is shown which includes a paint module 12 having an entrance end 14 and an exit end 16 and provided with a track 18 along which an automobile body 20 is conveyed into and out of the paint module 12 by a wheeled carrier 22 connected to a power driven conveyor chain 24. The paint module 12 serves as a spray booth which includes laterally spaced side walls 13 and 13' and a roof (not shown) and, in the preferred form, both the entrance end 14 and the exit end 16 of the paint module 12 can be automatically closed by doors (not shown) so as to provide a completely sealed chamber where the automobile body 20 can be painted while in a stationary position by four painting robots 26, 28, 30, and 32 located within the paint module 12. One advantage in using a paint module 12 such as described above is that the problem of overspray onto other bodies is eliminated and, consequently, lower air velocity is required for removing fumes and non-deposited atomized paint particles from the interior of the module 12. Each of the painting robots 26–32 is identical in construction and the portion of each robot located in the paint module is constructed with explosion-proof structure so as to allow the robot to safely operate during the painting operation.

More specifically and as seen in FIG. 2, each robot 26–32 is a five axis, hydraulically-operated unit which includes a base 34, a primary arm 36, a secondary arm 38, and a wrist 40 that terminates with a support head 42 which, in this case, supports an atomizing device 44. Each robot 26–32 is suitable for program-controlled movement to achieve universal work processing relationships with respect to the automobile body 20. The program control is achieved through a robot-control unit (not shown) which is to be located outside the paint module 12 and includes a built-in microcomputer for selectively actuating hydraulic drive means (not shown) operatively associated with the base 34, primary arm 36, secondary arm 38, and wrist 40 for achieving prescribed movements of the atomizing device 44 about the five control axes. In this regard, it will be noted that the base 34 is supported for controlled rotation about a first axis 46 in a rotary path 48 while the primary arm 36 is movable about a pivotal connection which provides a second axis 50 and movement in a curve path 52. The secondary arm 38 is pivotally supported at the upper end of the primary arm 36 and is movable about a pivotal connection which provides a third axis 54 and movement in a curve path 56. The wrist 40 is supported at the free end of the secondary arm 38 and carries the support head 42 which is movable relative to the secondary arm 38 about a fourth axis 58 which allows movement in the curved path 60 and is also rotatable about the longitudinal axis 61 of the secondary arm 38 in the rotary path 62.

The control of each of the robots 26–32 is provided by a computer-based supervisory controller 64, which is capable of receiving various electrical input signals and generating output signals for initiating the operation of the robots in accordance with a preprogrammed sequence of operation. The controller 64 is connected to a limit switch 66 which when tripped tells the controller 64 that the automobile body 20 has reached a predetermined position within the paint module relative to the robots 26–32. The controller 64 also controls the supply of electricity to an electric motor 68 which drives the conveyor chain 24 as it will be more fully explained hereinafter.

Robots providing programmed control movement about multi-axes as described above are commercially available and two models, either one of which can be used in practicing this invention, are Model OM5000 manufactured by Grayco Robotics Inc., 12898 Westmore Avenue, Livonia, Mich. 48150 and Model HPR-1 manufactured by Hitachi Limited, Tokyo, Japan and available through Interrad Corporation, 65 Harvard Avenue, Stamford, Conn., 06902.

The atomizing device 44 is connected by a bracket 70 to the support head 42 of the wrist 40 and includes a body portion which consists of a high voltage generator 72 and a high-speed bell 74 capable of rotating at speeds up to 30,000 RPM. A source 76 of pressurized air is connected to an air turbine drive 78 for rotating the bell 74 about the longitudinal axis 80 of the body portion of the atomizing device 44. During the high speed rotation of the bell 74, liquid paint is fed to the bell 74 from a paint reservoir 82 at a flow rate of approximately 350 cubic centimeters per minute and is mechanically atomized by the rotating bell. The bell is connected through the power generator 72 to a power supply 82 which normally is at 24 volts and is increased by the power generator 72 to 100,000 volts needed to electrostatically transfer the atomized paint particles to the grounded vehicle body 20. The electrostatic field created between the bell 74 and the automobile body 20 should be of sufficient intensity to achieve the desired electrostatic deposition. The electrostatic field serves to form the charged atomized paint particles into a cone-shaped pattern 84 which can be varied in diameter through conventional air-shaping ports (not shown) formed in the atomizing device 44. An atomizing device 44 of the type described above is manufactured by the aforementioned Interrad Corporation, and is identified as Model PPH-307.

As should be understood, prior to performing the painting operation an automobile body, such as the body 20, is located in the paint module 12 in a predetermined position, and the control unit of each of the robots 26–32 is placed in a "teach" mode at which time the atomizing device 44 associated with each robot is manually moved along the surface of the body maintaining the axis 80 substantially perpendicular to the particular area of the body to be coated. Inasmuch as the atomizing device 44 is movable about the aforementioned five control axes, the atomizing device 44 of each robot can follow a path which permits it to paint the roof, associated side panels, and be located within the engine compartment and trunk to paint normally hidden areas of the body. As seen in FIGS. 1 and 2, the automobile body 20 is of a size and configuration comparable to a General Motors Corporation "x" body. After the movement of the atomizing device 44 of each robot 26–32 has been programmed, the robot painting system 10 is ready to repeatedly paint bodies in a manner which will now be described.

In practicing the invention, the automobile body 20 can initially pass a model recognition detector (not shown) which sends a signal to the controller 64, which in turn, will command the robots 26–32 to select the particular program for the body concerned. The body 20 is then conveyed into the paint module 12 moving through the entrance end 14 and continuing to be moved by the chain 24 until it trips the lever 86 of limit switch 66 which then causes the controller 64 to discontinue energization of the drive motor 68. At this point, the automobile body 20 is located in the exact position it assumed during the teach mode. The controller 64 then commands each of the robots 26–32 to start its particular program for electrostatically painting the exterior and the interior portions of the automobile body 20 while the latter is maintained in the stationary position. Each robot then provides movement of its atomizing device 44 about the five control axes. It will be noted that inasmuch as the bell 74 rotates at a high RPM about the longitudinal axis 80 of the atomizing device 44, certain movements of the atomizing device 44, such as movement in the rotary path 62, will cause a force reaction to be applied to the head support 42 of the robot. This force reaction will attempt to prevent such movement and will be referred to herein as gyroscopic effect or gyroprecession. The gyroscopic effect can, if strong enough, cause the atomizing device 44 to experience erratic shaking movement which will cause the cone-shaped pattern 84 of the atomized paint (created by the electrostatic field) to be distorted resulting in poor transfer efficiency and low quality coverage. It has been calculated, however, that by having the atomizing device 44 weigh no more than eleven pounds, providing a bell with a diameter at the discharge edge of approximately 2 inches or somewhat less, and having the atomizing device 44 move relative to the body at an average speed no greater than 1.4 feet/second, the proper cone-shaped pattern 84 should be maintained and good quality painting achieved. During a test using the aforementioned Model PPH-307 Interrad atomizing device (which weighs 5.5 pounds and has a bell having a discharge edge diameter of approximately 2 inches) in combination with the Model HPR-1 Hitachi robot, it was established that this particular combination, if used in a robot painting system according to this invention, and having the support head 42 move relative to the body being painted at an average speed of approximately 10 inches per second, a paint transfer efficiency of 80 percent will be attained and 100 percent of the body can be painted.

As should be apparent, after the robots have completed their programmed movement relative to the automobile body 20, a signal is given to the controller 64, which in turn, causes energization of the electric motor 68 for causing the automobile body to be conveyed out of the paint module and another automobile body is then brought into the paint module 12 and the painting operation repeated.

Finally, it will be noted that although four robots are shown being used with the robot paint system 10, the entire automobile body 20 could be painted using two robots only. For example, if robot 28 and 30 only were located in the paint module 12 in the positions shown in FIG. 1, then when the automobile body 20 is properly positioned, the front one-half of the body 20 would be painted by the robots 28 and 30. Afterwards, the robots 28 and 30 could be repositioned along a horizontal track or the like to the positions normally occupied by the robots 26 and 32 to paint the rear one-half of the automobile body 20. In this manner, two of the robots shown could be eliminated and still have the entire vehicle painted in accordance with the present invention.

Although only one form of this invention has been shown and described, other forms will be readily apparent to those skilled in the art. Therefore, it is not intended to limit the scope of this invention by the embodiment selected for the purpose of this disclosure but only by the claims which follow.

The embodiments of the invention in which an exclusive property or privilege is claimed are defined as follows:

1. A robot paint system for painting a series of automobile bodies movable in an assembly line fashion along a guide track, said robot paint system comprising a paint module having at least two program-controlled robots located therein, said paint module including side walls, a roof and an entrance opening and an exit opening for said automobile bodies, means for closing said entrance opening and said exit opening to provide a sealed chamber for one of said automobile bodies after the latter enters said paint module, each of said robots having an arm provided with a support head which is movable about five control axes, means for conveying said one of said automobile bodies along said guide track into said paint module via said entrance opening and for stopping and maintaining said one of said automobile bodies in a stationary and predetermined position relative to said paint module prior to and during the painting of said one of said automobile bodies, a bell-type atomizing device mounted on said support head of said arm and having a sufficiently small predetermined size to enable said atomizing device to apply paint to hidden surfaces of said one of said automobile bodies and be inserted within the inner compartment areas of said one of said automobile bodies, means for rotating the bell of said atomizing device about its spin axis at a speed in excess of 20,000 rpm to cause mechanical atomization of a liquid paint supplied to said atomizing device, means for creating an electrostatic field between said bell of said atomizing device and said one of said automobile bodies for causing the atomized liquid paint to be directed from said atomizing device to said one of said automobile bodies in a cone-shaped pattern, and control means for causing said support head of said arm to move the atomizing device about said five control axes to different positions along a path that follows the surface contours of said one of said automobile bodies at a predetermined distance therefrom and at a speed which due to said predetermined size in coaction with said robot will prevent any gyroscopic effect from distorting said cone-shaped pattern due to movement of said atomizing device about said five control axes.

2. A robot paint system for painting a series of automobile bodies movable in an assembly line fashion along a guide track, said robot system comprising a paint module having at least two program-controlled robots located therein, said paint module including side walls, a roof and a pair of doors which respectively provide an entrance and exit for said automobile bodies and a sealed chamber therefor when said doors are closed, each of said robots having an arm provided with a support head movable about five control axes, means for conveying one of said automobile bodies along said guide track into said paint module via said entrance and locating said one of said automobile bodies in a stationary and predetermined position relative to said paint module, a bell-type atomizing device mounted on said support head of said arm and having a sufficiently small predetermined size to enable said atomizing device to apply paint to hidden surfaces of said one of said automobile bodies and be inserted within the inner compartment areas of one of said automobile bodies, means for rotating the bell of said atomizing device about its spin axis at a speed in excess of 20,000 rpm to cause mechanical atomization of a liquid paint supplied to said atomizing device, means for creating an electrostatic field between said bell of said atomizing device and said one of said automobile bodies for causing the atomized liquid paint to be directed from said atomizing device to said one of said automobile bodies in a cone-shaped pattern, and control means for causing said support head of said arm to move the atomizing device about said five control axes to different positions along a path that follows the surface contours of said one of said automobile bodies at a predetermined distance therefrom and at a speed which due to said predetermined size in coaction with said robot will prevent any gyroscopic effect from distorting said cone-shaped pattern due to movement of said atomizing device about said five control axes.

3. A robot paint system for painting a series of automobile bodies movable in an assembly line fashion along a guide track, said robot paint system comprising a paint module through which said guide track extends, said paint module having at least two program-controlled robots located therein one on each side of said guide track along which said automobile body travels, said paint module including side walls, a roof and a pair of doors which respectively provide an entrance and exit for one of said automobile bodies and a sealed chamber therefor when said doors are closed, each of said robots having an arm provided with a support head movable about five control axes, means for conveying said one of said automobile bodies along said guide track into said paint module via said entrance and for locating said one of said automobile bodies in a stationary and predetermined position relative to said paint module, a bell-type atomizing device mounted on said support head of said arm and having a sufficiently small predetermined size to enable said atomizing device to apply paint to hidden surfaces of said one of said automobile bodies and be inserted within the inner compartment areas of said one of said automobile bodies, means for rotating the bell of said atomizing device about its spin axis at a speed greater than 20,000 rpm so as to cause mechanical atomization of a liquid paint supplied to said atomizing device, means for creating an electrostatic field between said bell of said atomizing device and said one of said automobile bodies for causing the atomized liquid paint to be directed from said atomizing device to said one of said automobile bodies in a cone-shaped pattern, and control means for causing said one of said automobile bodies to be stopped in said predetermined position and causing said support head of said arm to move the atomizing device about said five control axes so as to coat the interior and exterior surfaces of said one of said automobile bodies with said atomized liquid paint by program-controlled movement of the rotating bell along said interior and exterior surfaces at a predetermined distance therefrom and at a speed no greater than 1.4 feet/-second so as to prevent any gyroscopic effect from distorting said cone-shaped pattern when said atomizing device is moved about said five control axes.

* * * * *